US006086340A

United States Patent [19]

Edwards et al.

[11] Patent Number: 6,086,340

[45] Date of Patent: Jul. 11, 2000

[54] METERING DIAPHRAGM PUMP HAVING A FRONT REMOVABLE HYDRAULIC REFILL VALVE

[75] Inventors: Phillip M. Edwards, Cherry Hill, N.J.; Robert J. Meehan, Roslyn, Pa.

[73] Assignee: Milton Roy Company, Ivyland, Pa.

[21] Appl. No.: 09/309,984

[22] Filed: May 11, 1999

[51] Int. Cl.[7] ..... F04B 23/00

[52] U.S. Cl. ..... 417/440; 417/413.1; 417/454

[58] Field of Search ..... 417/440, 454, 417/413.1

[56] References Cited

U.S. PATENT DOCUMENTS

| | | | |
|---|---|---|---|
| 1,627,257 | 5/1927 | Stevens | 417/440 |
| 2,578,746 | 12/1951 | Scherger et al. | 417/440 |
| 2,919,650 | 1/1960 | Wiggermann | 417/440 |
| 3,551,076 | 12/1970 | Wilson | 417/440 |
| 3,680,981 | 8/1972 | Wagner | 417/388 |
| 3,902,826 | 9/1975 | Nagel et al. | 417/386 |
| 4,192,223 | 3/1980 | Lombard | 92/5 R |
| 4,390,324 | 6/1983 | Karliner | 417/282 |
| 4,474,540 | 10/1984 | Bonastia et al. | 417/63 |
| 5,165,869 | 11/1992 | Reynolds | 417/385 |
| 5,655,885 | 8/1997 | Chung | 417/44.2 |

FOREIGN PATENT DOCUMENTS

| | | | |
|---|---|---|---|
| 9-310678 | 12/1997 | Japan | F04B 43/067 |

OTHER PUBLICATIONS

Milton Roy Metering Pump Technology—Bulletin 210 (dated Jul. 1998).

PULSA Series® Diaphragm Metering Pumps—Installation Operation Maintenance Instruction, Bulletin No. PMP–IOM–96.

LEWA—Fluid Metering—The Full Range, dated Nov. 1995.

*Primary Examiner*—Charles G. Freay
*Assistant Examiner*—Robert Z. Evora
*Attorney, Agent, or Firm*—Marshall O'Toole Gerstein Murray & Borun

[57] ABSTRACT

A hydraulic refill valving apparatus can be removed from the front of a metering pump without requiring the entire displacement chamber to be removed from the pump drive mechanism. The valving apparatus separately mounts a mechanically actuated refill valve and a refill check valve such that they can be removed from the front of the pump with relative ease, leaving the displacement chamber connected to the drive mechanism with the sealing gasket therebetween. By separating the refill valve and refill check valve functions into two separate assemblies, the apparatus is made more reliable in that it is less susceptible to problems encountered with relatively high viscosity working fluid.

21 Claims, 5 Drawing Sheets

METERING DIAPHRAGM PUMP HAVING A FRONT REMOVABLE HYDRAULIC REFILL VALVE

TECHNICAL FIELD

The present invention relates generally to valves, and more particularly relates to hydraulic valves for metering pumps.

BACKGROUND OF THE INVENTION

A hydraulically actuated diaphragm metering pump operates by means of a reciprocating plunger energizing, or pressurizing, a volume of hydraulic working fluid, typically oil, contained behind a flexible diaphragm. On the side of the diaphragm opposite the plunger, process fluid is provided and contained within the diaphragm head of the pump. Pressurization of the working fluid by the forward movement of the pump plunger in turn causes flexure of the diaphragm, which displaces the process fluid through a discharge check valve in the pump diaphragm head. The stroke length of the pump plunger is controllably variable so that the amount of process fluid released per stroke can be adjusted to a desired volume.

The working fluid is typically contained within a vessel called a displacement chamber which houses the pump plunger and which is connected to a relatively large reservoir of hydraulic fluid. Under normal operating conditions, a small quantity of working fluid escapes from the displacement chamber during each forward stroke of the pump plunger. This normal leakage of working fluid back to the reservoir occurs through the clearance between the plunger and displacement chamber, as well as through a continuous air bleed valve found in most hydraulically actuated diaphragm pumps. For the pump to be capable of continuing to deliver the process fluid at the required flow rate, this lost working fluid must be replenished to maintain the balance of hydraulic fluid behind the diaphragm.

Many manufacturers therefore equip their metering pumps with mechanically actuated refill valves in the pump displacement chamber to maintain this balance. This valve operates under the principle that a need for working fluid refill in the displacement chamber will cause the diaphragm to migrate back toward the rear of the chamber where the mechanically actuated refill valve is typically located. In other words, the need for a working fluid refill causes a negative pressure condition in the displacement chamber during the suction stroke portion of the cycle, which pulls the diaphragm back against the valve thereby causing the valve to open. Once the valve is open, working fluid flows from the reservoir through the refill valve, and into the displacement chamber.

In addition to the refill valve, such metering pumps are typically provided with a refill check valve serving as a somewhat redundant safeguard to ensure that even though the diaphragm may be pulled back against the refill valve, a significant negative pressure must be provided within the displacement chamber (sufficient working fluid has escaped) to warrant release of additional working fluid into the displacement chamber. In other words, under certain operating conditions, the diaphragm may be pulled back even though refill is not required, and the refill check valve serves as a secondary confirmation that refill is required. If no refill check valve were to be provided, working fluid refill might create an overfill condition within the displacement chamber, which would overextend and rupture the diaphragm.

For example, in one known refill valve, an actuation button attached to a valve stem is provided between the displacement chamber and the diaphragm. The actuation button is biased toward the diaphragm using a spring, but can be depressed if the diaphragm is pulled backward. In such a design, even though the actuation button may be pushed rearward by the diaphragm, a poppet is slidably mounted to the rear of the valve stem and seated against a valve seat to prevent refill fluid from entering the displacement chamber until the poppet itself is moved. A second spring acts in conjunction with the poppet to provide the refill check valve purpose in that sufficient negative pressure must be provided within the displacement chamber to overcome the biasing force of the second spring before refill fluid will be allowed to pass through.

While such a prior art refill valve and refill check valve combination has proven to be functional, difficulties can be encountered in the sliding action between the poppet and the valve stem, particularly when the viscosity of the working fluid increases. Such increase in viscosity can occur if maintenance personnel do not regularly change the working fluid, or if temperature fluctuations are encountered. Increased viscosity will lead to higher viscous drag forces between the sliding poppet and valve stem which can prevent the poppet from moving away from the valve seat even when substantial negative pressures within the displacement chamber are reached. This, in turn, can starve the displacement chamber of working fluid, and thus negatively affect pump performance.

In addition, periodic maintenance of the refill valve and refill check valve is required. In order to service such valves, they first must be removed from the metering pump. More specifically, the displacement chamber must be removed from the drive assembly, which in prior designs has required several persons and the use of a crane. Additionally, the displacement chamber is separated from the pump drive by a custom sealing gasket, which is not designed to be reusable. Therefore, removal of the displacement chamber necessitates replacement of this custom gasket as well.

SUMMARY OF THE INVENTION

One preferred embodiment on the present invention is provided in the form of a hydraulic valving apparatus comprising a refill valve, a refill check valve, and a housing in which the refill valve and refill check valve are separately and removably mounted. The apparatus is preferably, although not necessarily, adapted for use in fluid communication with a pump.

In another preferred embodiment, the present invention is provided in the form of a metering pump of the type having a liquid end and a displacement chamber separated by a diaphragm with the piston reciprocatingly driven in the displacement chamber by a pump drive, and a valving apparatus. The valving apparatus preferably includes a refill valve wherein the refill valve is removable from the metering pump without removing the displacement chamber from the pump drive.

Typically, the liquid end includes a diaphragm head proximate the diaphragm, and the refill valve is preferably removable from the pump after the diaphragm head and diaphragm are removed. The refill valve also preferably includes an actuation button proximate the diaphragm, a poppet engageable against a valve seat, and a stem fixedly connecting the poppet to the actuation button, with a spring biasing the poppet and button toward the diaphragm.

In one embodiment, a refill check valve is also provided and removable from the pump without removing the displacement chamber from the pump drive. The refill check valve preferably includes a ball held against the valve seat by a biasing spring, with the spring having a predetermined biasing force selected to be less than the force exerted by the pressure differential across the ball when refill of working fluid is required. The refill check valve is preferably, although not necessarily, threadably attached to the pump for ease of removal.

In accordance with another aspect of the present invention, a method is provided for replacing a refill valving apparatus of a metering pump of the type having a drive mechanism reciprocating a plunger within a displacement chamber filled with working fluid, and a working fluid reservoir in communication with the displacement chamber and separated by a refill valve. With each stroke of the plunger, the diaphragm is caused to move into the diaphragm head and release a metered amount of process fluid. The method preferably includes the steps of removing the diaphragm head from the metering pump, removing the diaphragm from the metering pump, and pulling the refill valve from the metering pump with the displacement chamber remaining attached to the drive mechanism.

In another preferred embodiment wherein the pump further includes a refill check valve, the method further includes the steps of draining the working fluid from the working fluid reservoir, and pulling the refill check valve from the metering pump.

Other aspects and advantages of the present invention will become apparent upon consideration of the following drawings and detailed description.

DESCRIPTION OF THE PREFERRED EMBODIMENT

Referring now to FIGS. 1–4, a metering pump 10 is driven by a motor 12 and delivers a controlled quantity of a process fluid into a conduit or receptacle (not shown). The metering pump may be of the hydraulically actuated type, mechanically actuated type, or the electromagnetically actuated type.

Figure 1:
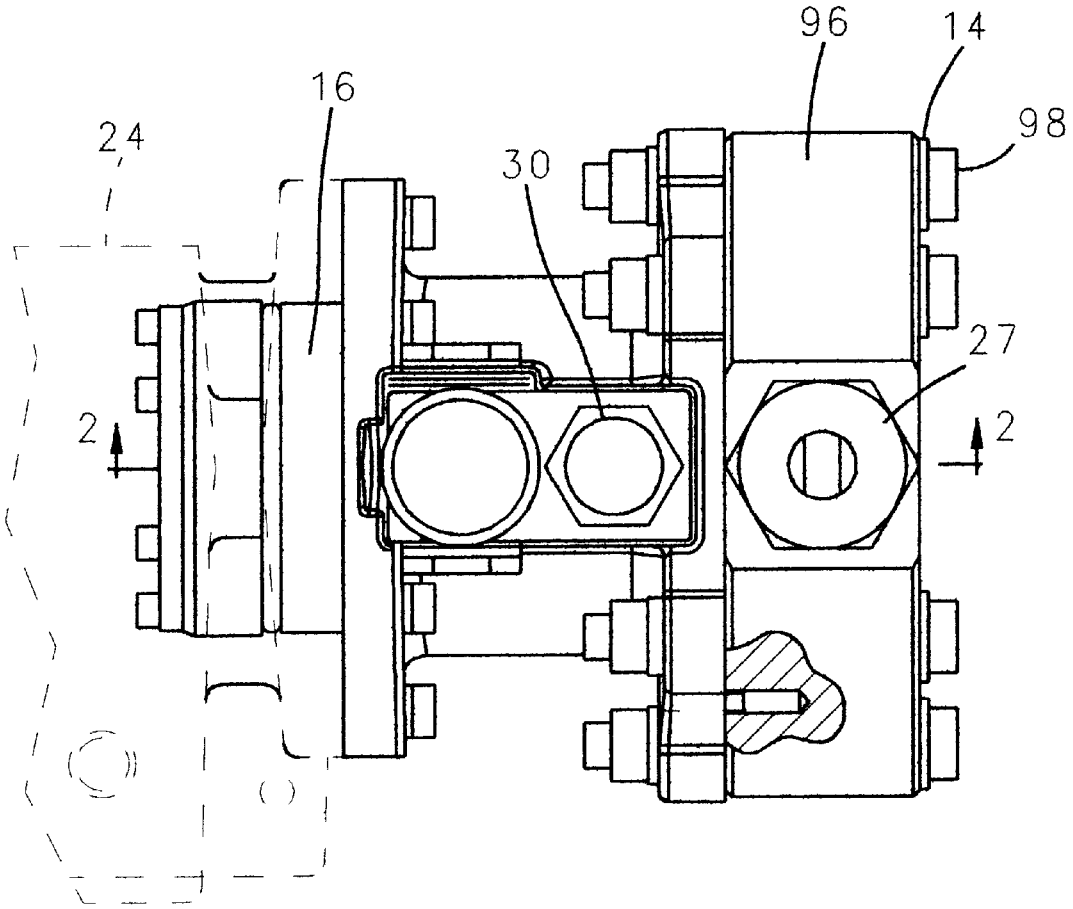
FIG. 1 is a plan view of the liquid end and displacement chamber of a metering pump incorporating the present invention.
Figure 2:
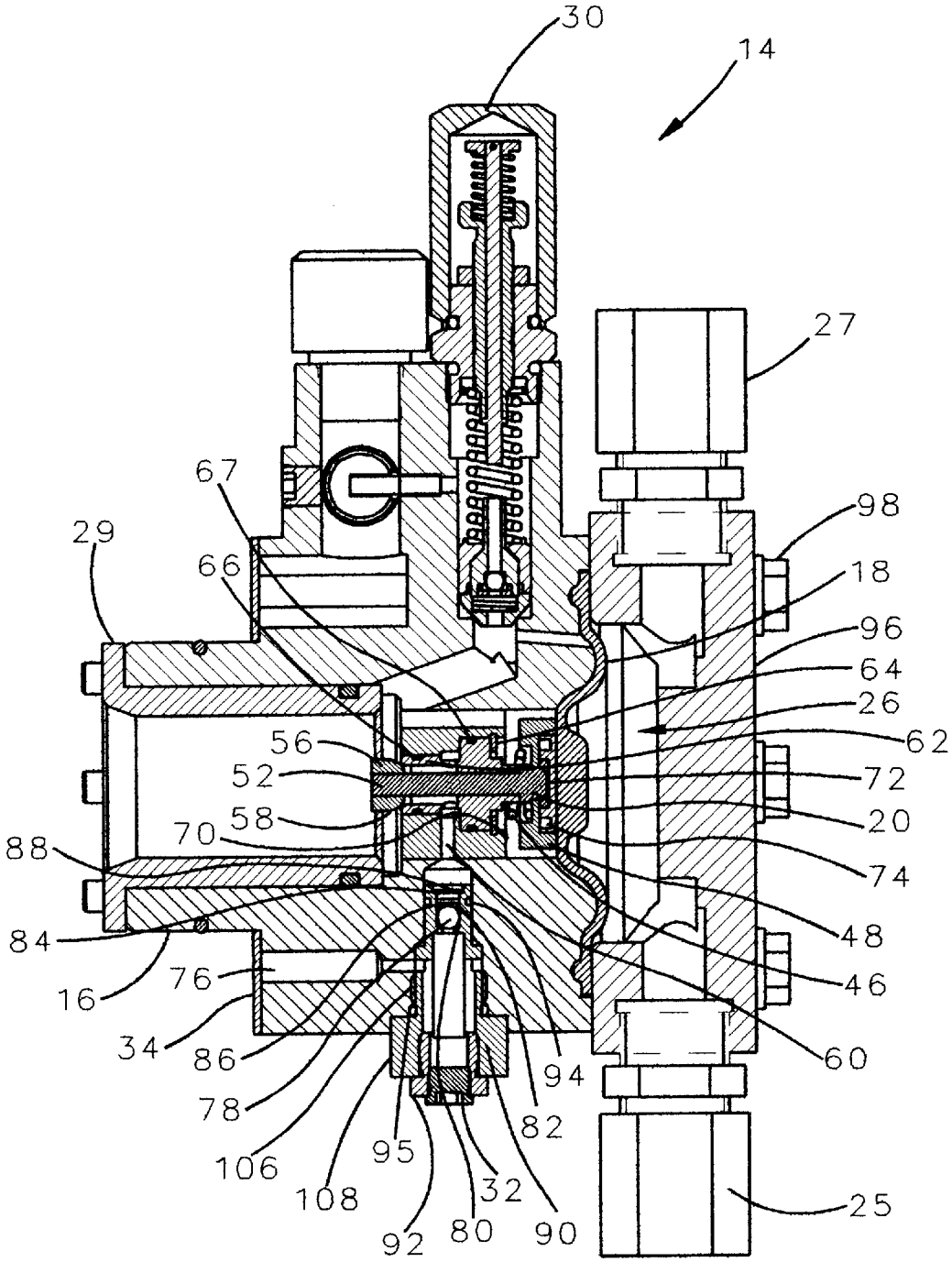
FIG. 2 is a partial sectional view of FIG. 1 taken generally along lines 2—2 of FIG. 1.
Figure 3:
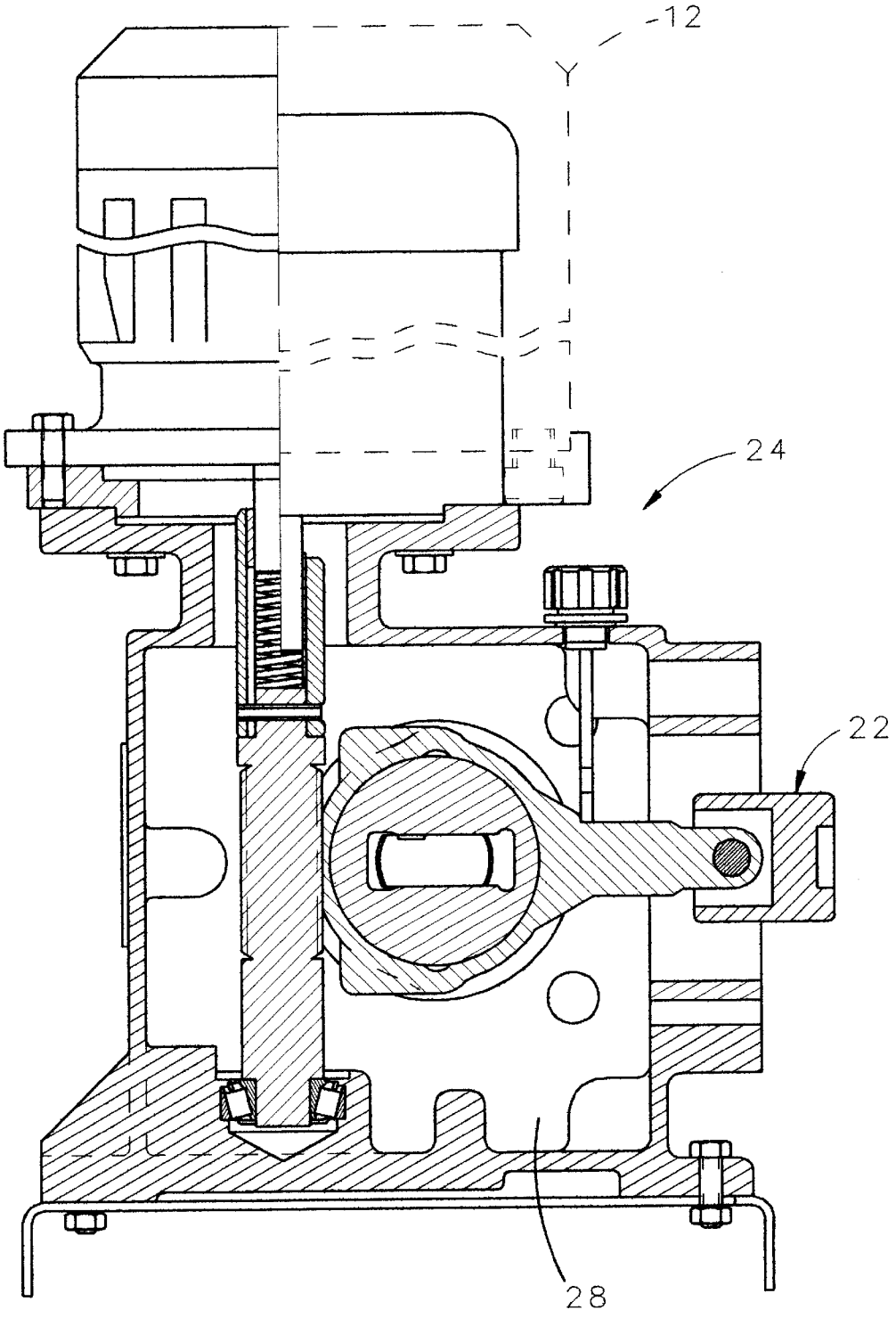
FIG. 3 is a partial sectional view of the drive end of a metering pump incorporating the present invention taken generally along the same sectional plane as FIG. 2.
Figure 4:
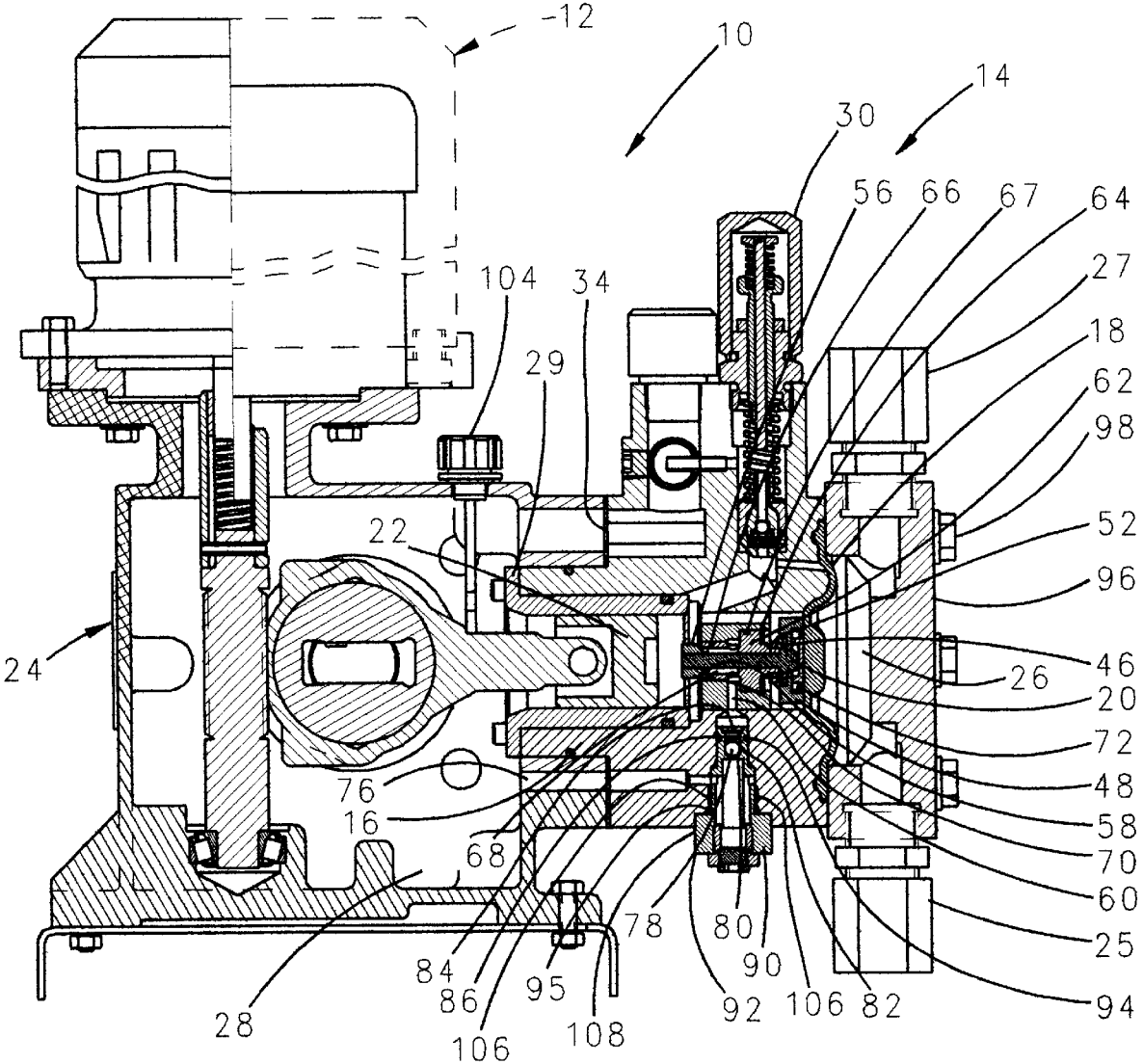
FIG. 4 is a sectional view of the drive end and liquid end in combination.

As shown best in FIGS. 2–4, the pump 10 is preferably of the hydraulically actuated type and includes a liquid end 14 which is separated from a displacement chamber 16 by a diaphragm 18 and a mechanically actuated refill valve 20. A piston or plunger 22 is disposed in the displacement chamber 16 and is reciprocated therein by a drive assembly 24.

In operation, reciprocation of the plunger 22 in the displacement chamber 16 results in reciprocating movement of the diaphragm 18 during suction and discharge strokes of the pump 10. During each suction stroke, process fluid is drawn through one or more check valves 25 into a diaphragm head chamber 26. During each discharge stroke, process fluid is discharged from the diaphragm head chamber 26 through one or more additional check valves 27.

During normal operation, a small amount of working fluid (e.g., oil) escapes from the displacement chamber 16 and into a reservoir 28 and the drive assembly 24 either through the clearance between the plunger 22 and a displacement chamber sleeve 29, or through a multifunction valve 30. Eventually, the quantity of working fluid in the displacement chamber 16 is reduced to an extent which causes the diaphragm 18 to contact and open the refill valve 20 during one or more suction strokes of the pump.

As will be discussed in further detail herein, the opening of the refill valve 20 causes working fluid to flow from the reservoir 28 into displacement chamber 16, if a spring loaded check valve 32 is open as well. Eventually, sufficient make-up working fluid is supplied to the displacement chamber 16 to prevent further actuation of the refill valve 20 during subsequent suction strokes. In this fashion, the amount of working fluid in displacement chamber 16 is maintained at a level sufficient to ensure continued proper operation of pump 10.

Moreover, through the unique structure of the present invention, the refill valve 20 and the spring loaded check valve 32 are separately operable and installed to not only ensure continued proper operation, but also allow for ease of replacement and maintenance when required without removal of the entire displacement chamber 16 from the drive assembly 24. Since the displacement chamber 16 need not be removed from the drive assembly 24, a sealing gasket 34, disposed between the displacement chamber 16 and the drive assembly 24, need not be replaced when the refill valve 20 and the check valve 32 are serviced.

Referring now to FIG. 2, the liquid end 14 of the pump 10 is shown in detail. The refill valve 20 is shown between the displacement chamber 16 and the diaphragm 18. One of ordinary skill in the art will readily recognize that the diaphragm 18 is flexible such that a discharge stroke of the plunger 22 will cause movement of the diaphragm 18 into the diaphragm head chamber 26, and thus release process fluid contained therein through the check valve 27. If sufficient working fluid has escaped from the displacement chamber 16, a negative pressure will be created within the displacement chamber 16 during each suction stroke which creates a pressure differential across the diaphragm 18 sufficient to draw the diaphragm 18 toward the refill valve 20. If the pressure differential across the diaphragm 18 is sufficient, a spring 46, which normally biases an actuation button 48 toward the diaphragm 18, will be compressed.

Figure 5:
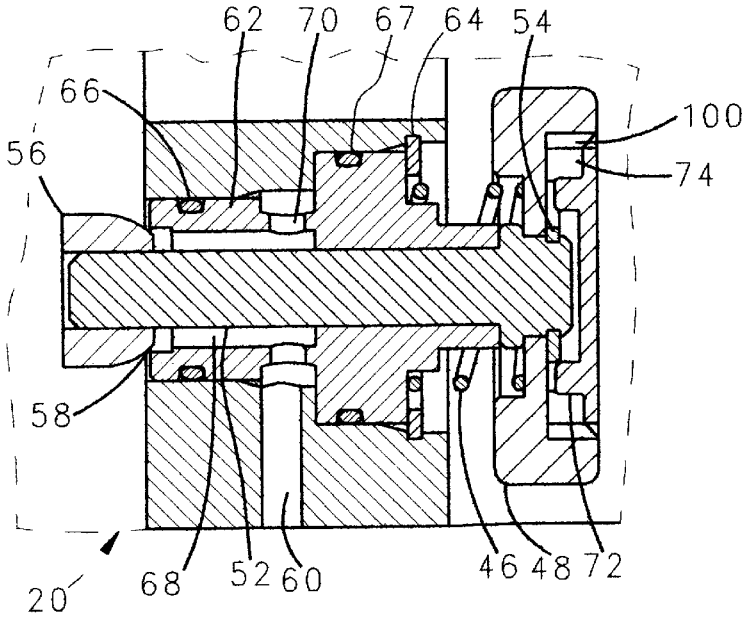
FIG. 5 is an enlarged sectional view showing the mechanically actuated refill valve of the preferred embodiment in an open position.

Referring to FIGS. 2 and 5, the actuation button 48 is fixedly attached to a valve stem 52 by a retaining ring 54. Consequently, movement of the actuation button 48 against the force exerted by the spring 46 causes a poppet 56 carried by the valve stem 52 to move away from a valve seat 58 and thus allow refill working fluid to move from the reservoir 28 through a refill port 60 into the displacement chamber 16. The valve stem 52 is adapted for movement within a refill valve body 62, which itself is held within the displacement chamber 16 by a retaining clip 64. In the preferred embodiment, first and second annular sealing rings 66, 67 are provided between the refill valve body 62 and the displacement chamber 16. Moreover, to facilitate communication of working fluid from the refill port 60 to the valve seat 58, it will be noted that the refill valve body 62 includes an interior chamber 68 having an inlet 70. It will also be noted from FIG. 5 that actuation button 48 includes a plug 72 which is frictionally engaged within a recess 74 of the actuation button 48 to provide a flush end for the actuation button 48, and thus facilitate contact between the diaphragm 18 and the actuation button 48.

Figure 7:
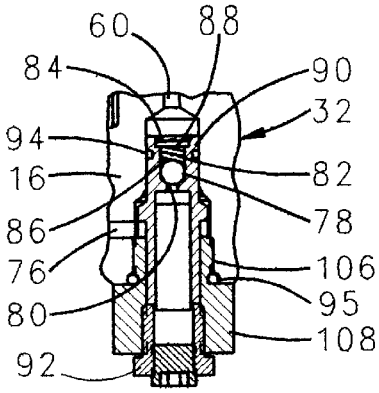
FIG. 7 is an enlarged sectional view of the refill check valve.

As indicated above, even if the diaphragm 18 is pulled toward the actuation button 48 due to negative pressure within the displacement chamber 16, working fluid will not be communicated through the refill port 60 unless the refill check valve 32 is open as well. Turning now to FIGS. 4 and 7, the refill check valve 32 is shown, in the preferred embodiment, disposed between the refill port 60 and a passage 76 which is in direct communication with the reservoir 28. In the preferred embodiment, the refill check valve 32 includes a ball 78, which is normally held against a valve seat 80 by the biasing force of a spring 82, which itself is held between the ball 78 and an end plate 84 retained within a channel 86. The end plate 84 includes an interior orifice 88 to allow for communication of working fluid. If significant negative pressure exists within the displacement chamber 16 such that a sufficient pressure differential exists across the ball 78, the spring 82 compresses, the ball 78 moves away from the valve seat 80, and working fluid will pass from the reservoir 28 through the passage 76, the refill port 60, and the refill valve 20 into the displacement chamber 16. Moreover, since the refill check valve function is performed separately from the refill valve function, the viscous drag forces and detrimental effects associated with prior art devices is avoided with the present invention.

As shown best in FIGS. 2,4, and 7, the refill check valve 32 includes a substantially cylindrical body 90 which includes the aforementioned channel 86 within which the ball 78 and the spring 82 are disposed. An end of the cylindrical body 90 opposite the spring 82 includes a removable oil strainer 92, preferably being threadably attached thereto. The removable oil strainer filters out large particles from the working fluid to ensure that clean working fluid is flowing past the ball 78 and the refill poppet 56. If left unfiltered, such contaminants could damage sealing surfaces and prevent proper sealing of the ball and poppet against the mating seats and moreover, through the use of the aforementioned threaded attachment, the oil strainer 92 can be easily removed from the cylindrical body 90 even while the cylindrical body 90 and the refill check valve 32 remain in operational position. The figures also show that first and second sealing rings 94, 95 are provided between the cylindrical body 90 and the displacement chamber 16 to provide a fluid-tight fit.

As indicated above, the present invention is also directed to a valving apparatus for a diaphragm metering pump which allows for the refill valve 20 and the refill check valve 32 to be easily removed from the front of the pump 10 without removing the entire displacement chamber 16 from the drive assembly 24, and thus replacing the sealing gasket 34 therebetween as well. The preferred embodiment of the present invention accomplishes this by separately mounting the refill valve 20 and refill check valve 32 within displacement chamber 16 such that they can be easily removed.

Figure 6:
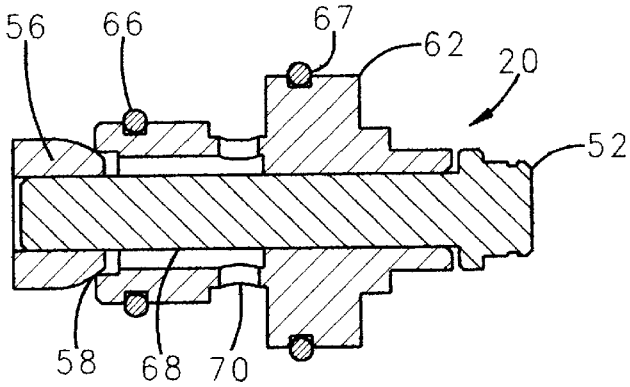
FIG. 6 is a sectional view of the mechanically actuated refill valve of FIG. 5 removed from the displacement chamber.

As shown in FIGS. 2 and 4, the refill valve 20 is positioned between the displacement chamber 16 and the diaphragm 18. Therefore, one may remove the refill valve 20 from the displacement chamber 16 while leaving the displacement chamber 16 directly connected to the drive assembly 24, by bringing the process liquid within the diaphragm head chamber 26 to atmospheric pressure (if it is not already at atmospheric pressure), removing fasteners 98, removing the diaphragm head 96 from the displacement chamber 16, removing the diaphragm 18 from the displacement chamber 16, and removing the refill valve 20 itself. The refill valve 20 is preferably removed using the following steps: a small utensil or tool, such as a screwdriver, can be inserted into an aperture 100 and used to pry the cover or plug 72 away from the actuation button 48; the valve stem retaining ring 54 can then be removed to allow the actuation button 48 and the spring 46 to be removed; and the valve body retaining ring 64 can then be removed to permit the entire refill valve assembly 20 (as shown in FIG. 6) to be removed from the displacement chamber 16. To facilitate this last step, it is preferred to have the retaining ring 54 reinstalled onto the valve stem 52 to provide a surface to be gripped with a tool, such as a pair of pliers, to allow for sufficient pulling force to be imparted against the refill valve 20 without damage occurring thereto. The refill valve 20 can then be repaired or easily replaced.

With regard to the refill check valve 32, it can also be easily replaced or removed for maintenance purposes while allowing the displacement chamber 16 to remain connected to the drive assembly 24, leaving the sealing gasket 34 intact. More specifically, the refill check valve 32 can be removed by first draining the working fluid from the reservoir 28. Once the working fluid is drained from the pump housing reservoir, a tool, such as a wrench, can be used to rotate the cylindrical body 90 relative to the displacement chamber 16, thus unscrewing threads 106 to allow the entire valve assembly 32 to be removed. To facilitate this operation, it will be noted that the cylindrical body 90 includes a hex-head 108 designed to inter-fit with the aforementioned wrench or similar tooling.

From the foregoing, it can be seen that the refill valve and associated refill check valve can be easily removed, maintained and replaced without requiring the entire pump displacement chamber to be disassembled from the pump drive mechanism. Not only does such a system lessen the man-hours required for replacing such units, but provides a more reliable valve combination which is not as susceptible as the prior art to viscous drag between the refill valve and the refill check valve.

What is claimed is:

1. In a metering pump of the type having a liquid end and a displacement chamber separated by a diaphragm, and a piston reciprocatingly driven in the displacement chamber by a pump drive, a valving apparatus, comprising:

a refill valve structurally separate from and actuated by movement of the diaphragm, wherein the refill valve is removable from the metering pump without removing the displacement chamber from the pump drive.

2. The metering pump of claim 1 further including a refill check valve removable from the metering pump without removing the displacement chamber from the pump drive.

3. The metering pump of claim 2 wherein the refill check valve is threadably attached to the displacement chamber.

4. The metering pump of claim 2 wherein the refill check valve further includes a replaceable filter element.

5. The metering pump of claim 1 wherein the pump drive and displacement chamber are separated by a sealing gasket.

6. The metering pump of claim 1 wherein the refill valve includes an actuation button adjacent to the diaphragm, a sealing poppet engageable against a valve seat, a stem fixedly connecting the sealing poppet to the actuation button, and a spring biasing the sealing poppet and actuation button toward the diaphragm.

7. The metering pump of claim 6 wherein the actuation button includes a detachable cover.

8. The metering valve of claim 5 wherein movement of the diaphragm away from the displacement chamber causes a metered release of a process liquid, movement of the diaphragm toward the displacement chamber causes the stem and poppet to move away from the valve seat to open the refill valve.

9. The metering valve of claim 8 wherein the pump further includes a refill check valve and a working fluid reservoir adapted to fill the displacement chamber when the refill valve and refill check valve are open, and wherein the refill check valve includes a replaceable filter media element.

10. The metering pump of claim 1 wherein the refill check valve includes a ball held against a valve seat by a biasing spring, the spring having a predetermined biasing force selected to be less than a force exerted by a pressure differential across the ball when refill of working fluid is required.

11. A method for replacing refill valving apparatus of a metering pump of the type having a drive mechanism powering a plunger within a displacement chamber filled with working fluid, each stroke of the plunger causing a diaphragm separating the displacement chamber from a process fluid diaphragm head to move into the diaphragm head and release a metered amount of process fluid, the metering pump further including a working fluid reservoir in fluid communication with the displacement chamber and separated by a refill valve, the method comprising the steps of:

removing the diaphragm head from the metering pump;

removing the diaphragm from the metering pump;

prying a cover off an actuation button of the refill valve; and pulling the refill valve from the metering pump with the displacement chamber remaining attached to the drive mechanism.

12. The method of claim 11 further including the steps of removing retaining rings and the actuation button prior to the pulling step.

13. The method of claim 11 wherein the pump further includes a refill check valve and the method further includes the steps of:

draining the working fluid from the working fluid reservoir;

pulling the refill check valve from the metering pump.

14. The method of claim 13 wherein the refill check valve is threadably attached to the metering pump and the method further includes the step of unscrewing the refill check valve from the metering pump prior to the pulling step.

15. In a metering pump of the type having a liquid end and a displacement chamber separated by a diaphragm, and a piston reciprocatingly driven in the displacement chamber by a pump drive, a valving apparatus, comprising:

a refill valve comprising:

an actuation button adjacent to the diaphragm;

a sealing poppet engagable against a valve seat;

a stem fixedly connecting the sealing poppet to the actuation button; and a spring biasing the sealing poppet and actuation button toward the diaphragm;

wherein the refill valve is removable from the metering pump without removing the displacement chamber from the pump drive.

16. The metering pump of claim 15 further including a refill check valve removable from the metering pump without removing the displacement chamber from the pump drive.

17. The metering pump of claim 16 wherein the refill check valve includes a ball held against a valve seat by a biasing spring, the biasing spring having a predetermined biasing force selected to be less than a force exerted by a pressure differential across the ball when refill of working fluid is required.

18. The metering pump of claim 16 wherein the refill check valve is threadably attached to the displacement chamber.

19. The metering pump of claim 16 wherein the refill check valve further includes a replaceable filter element.

20. The metering pump of claim 15 wherein the pump drive and displacement chamber are separated by a sealing gasket.

21. The metering pump of claim 15 wherein the refill valve actuation button includes a detachable cover.

* * * * *